US006513685B1

(12) United States Patent
Tzoubris

(10) Patent No.: US 6,513,685 B1
(45) Date of Patent: Feb. 4, 2003

(54) RING SECURING DEVICE

(76) Inventor: Anthony Tzoubris, 837 Rosebud Ct., Roselle, IL (US) 60172

( * ) Notice: Subject to any disclaimer, the term of this patent is extended or adjusted under 35 U.S.C. 154(b) by 0 days.

(21) Appl. No.: 09/847,888

(22) Filed: May 2, 2001

(51) Int. Cl.[7] ..... A41D 19/00
(52) U.S. Cl. ..... 223/111; 2/170
(58) Field of Search ..... 2/159, 170, 21; 63/1.18, 15.8, 3.1; 223/111

(56) References Cited

U.S. PATENT DOCUMENTS 732,532 A * 6/1903 Fallek
1,628,278 A * 5/1927 Scheur
3,656,244 A * 4/1972 Andrade ..... 36/1
4,121,360 A * 10/1978 Vlerebome
4,215,556 A 8/1980 Mroz
5,466,215 A * 11/1995 Lair et al. ..... 602/21
5,581,924 A 12/1996 Peterson
6,094,747 A 8/2000 Malick
D432,760 S 10/2000 Brachfeld

* cited by examiner

*Primary Examiner*—Rodney M. Lindsey
*Assistant Examiner*—James G Smith
(74) *Attorney, Agent, or Firm*—Bullwinkel Partners Ltd.

(57) ABSTRACT

A device for securing a ring to a person's finger. The device comprises an elongated loop connected at one end to a wristband. The loop has a free end away from the wristband that can be threaded through the ring, after which the wristband is threaded though the loop between the free end and the ring and pulled until the loop is wrapped snugly around the ring. The ring is then placed on the person finger and the wristband is placed in the person's wrist, thereby securing the ring.

2 Claims, 1 Drawing Sheet

FIG. 1
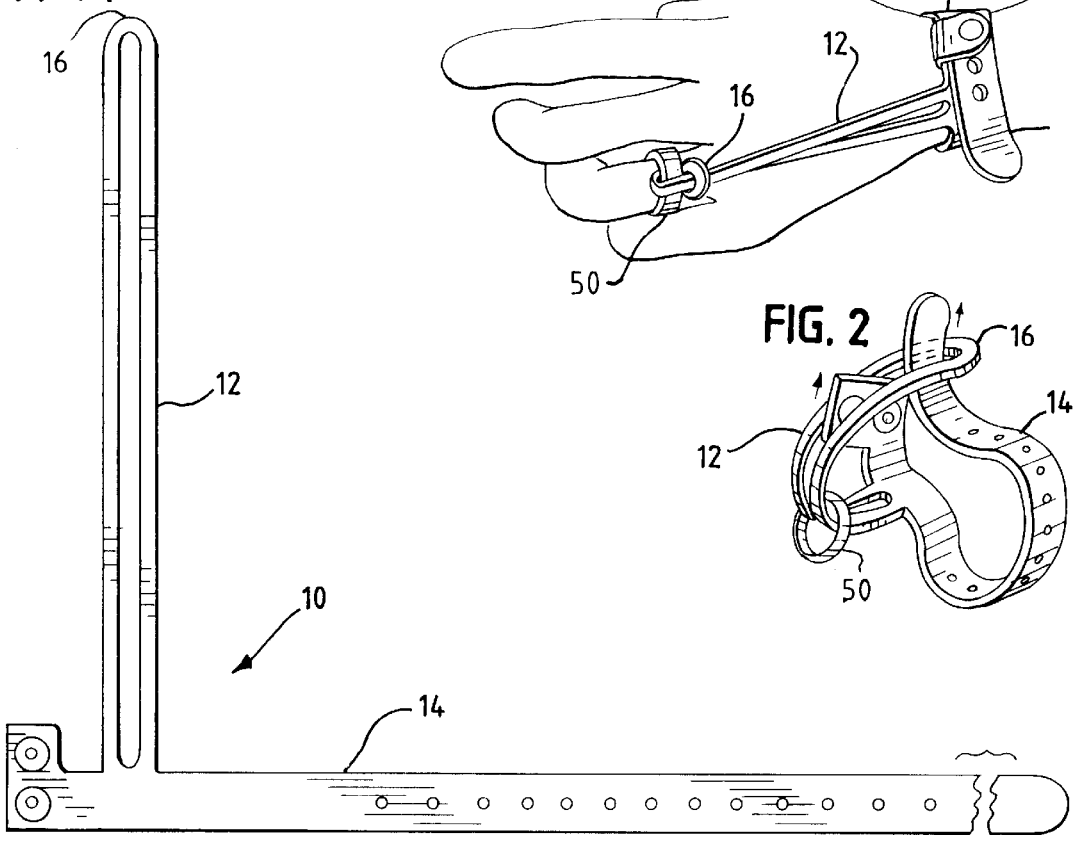
FIG. 3
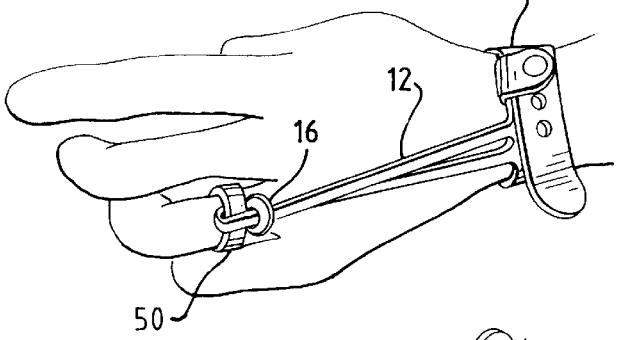
FIG. 2
FIG. 4
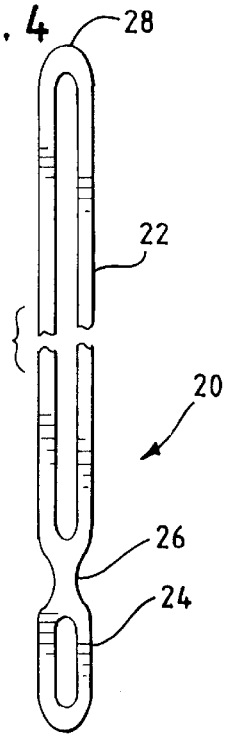
FIG. 6
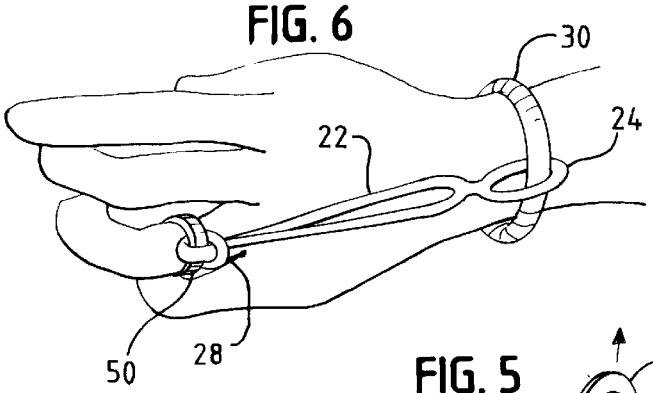
FIG. 5
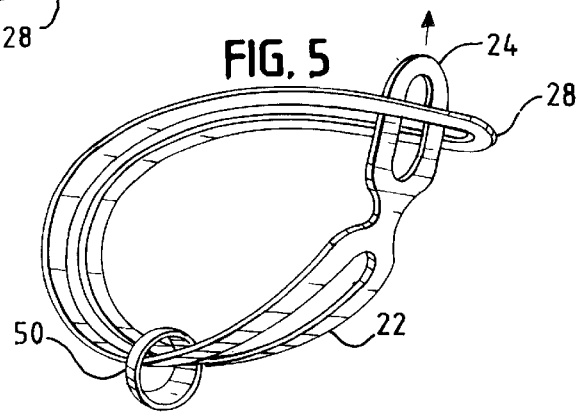

RING SECURING DEVICE

BACKGROUND

1. Field of the Invention

This patent relates to a device for securing a ring to a finger or toe.

2. Description of the Related Art

There are a number of patents relating to means for securing a ring to a finger or toe. For example, Malick U.S. Pat. No. 6,094,747 discloses a ring retaining device comprising a wristband, a retaining ring worn on the finger adjacent to, but outward from, the ring to be secured, and a resilient strip connecting the wrist band to the retaining ring. By placing the retaining ring outward from the ring to be retained, it becomes virtually impossible for the wearer to lose the ring.

In one alternative embodiment, the Malick device lacks the retaining ring portion and instead, the resilient strip is threaded through the ring to be secured and then folded back on itself and attached thereto with hook and loop type fasteners. However, since even hook and loop type fasteners can accidentally disengage, this alternative embodiment can result in the inadvertent loss of the ring. The present invention provides a more secure way to retain a ring on a finger.

SUMMARY OF THE INVENTION

The present invention is a device for securing a ring to a person's finger. The device comprises an elongated loop connected at one end to a wristband. The loop has a free end away from the wristband that can be threaded through the ring, after which the wristband is threaded though the loop between the free end and the ring and pulled until the loop is wrapped snugly around the ring. The ring is then placed on the person finger and the wristband is secured to the person's wrist, thereby securing the ring.

In an alternative embodiment to be used with a separate wristband, the device comprises a relatively long loop connected to a relatively short loop by a stem piece. The long loop has a free end away from the short loop that can be threaded through a ring, after which the short loop is threaded through the long loop between the free end and the ring and pulled until the long loop is wrapped snugly around the ring. The short loop is configured such that a wristband, such as a watch or bracelet, may be threaded through the short loop and then fastened around the person's wrist to secure the ring.

THE DRAWINGS

FIG. 1 is a top planar view of a ring securing device according to the present invention.

FIG. 2 is a perspective view of the ring securing device of FIG. 1 being threaded through itself prior to installing it on a hand and wrist.

FIG. 3 is a perspective view of the ring securing device of FIG. 1 installed on a hand and wrist.

FIG. 4 is a top planar view of an alternative embodiment of a ring securing device according to the present invention.

FIG. 5 is a perspective view of the ring securing device of FIG. 4 being threaded through itself prior to being installed on a hand and wrist.

FIG. 6 is a perspective view of the ring securing device of FIG. 4 installed on a hand and wrist.

DETAILED DESCRIPTION OF THE INVENTION

Turning to the drawings, there is shown in FIG. 1 one embodiment of the present invention, a device 10 for securing a ring on a finger. The device 10 comprises an elongated loop 12 connected to a wristband 14. Preferably the loop 12 and wristband 14 are formed from a single piece of material. The loop 12 attaches to the ring and the wristband 14 attaches to the user's wrist, as described below. The loop 12 must be of sufficient length to extend from the user's wrist to and through the ring to be secured. Preferably the loop 12 has sufficient elasticity to allow free movement of the hand and ring finger relative to the wrist.

The wristband 14 may be any type that fastens securely around the wrist, such as those distributed by Precision Dynamics Corporation of San Fernando, Calif. under the trademarks VISA BAND™ and SECUR-TICKET®, including the pocket-style identification bracelet disclosed in U.S. Pat. No. 5,581,924, incorporated herein by reference. Preferably, the wristband 14 can be adjusted for different size wrists. In the illustrated embodiment, the wristband 14 has a button-in-hole type fastening means, although any suitable fastening means may be used. Alternatively, the wristband may be continuous and simply slip over the user's wrist.

The device 10 works in the following manner. While the ring to be retained is off the user's finger, the user inserts the free end 16 of the loop 12 through the ring 50, then threads the wristband 14 and remainder of the loop 12 through the portion of the loop 12 between the free end 16 and the ring 50 (FIG. 2) until the ring 50 is securely held by the loop end 16. Next, the user places the ring 50 over one of her fingers, preferably but not necessarily with the loop 12 adjacent the back of her hand, and fastens the wristband 14 around her wrist as shown in FIG. 3. If the wristband is continuous, the user may insert her hand through the wristband and then place the ring over a finger. To remove the device 10, the procedure is repeated in reverse.

When the device 10 is installed on a user's hand and wrist, the ring 20 is securely retained on the user's finger, and cannot be lost even if the ring should slip off the finger.

FIG. 4 shows an alternative embodiment of the invention to be used in conjunction with watches, bracelets or any other suitable type of wristband. In this embodiment, the device 20 comprises a relatively long loop 22 connected to a relatively shorter loop 24 by a stem piece 26. To use the device 20, the user threads the free end 26 of the long loop 22 through the ring 50 to be retained, then threads the short loop 24 through the large loop 22 (see FIG. 5) until the ring is securely held by the large loop 22. Next, the user threads an end of a watch, bracelet or other wristband 30 through the short loop 24 and fastens the band 30 around her wrist, as shown in FIG. 6.

The ring securing device may be reused or disposed of after a single use. In one anticipated embodiment, the retaining device is made from laminated plastic sheet material, although any suitable material, such as leather or rubber, may be used.

The device may be used to secure a ring to any finger of either hand or to a thumb. The device may also be used to secure a ring to a toe by using an ankle band instead of a wristband.

Other modifications and alternative embodiments of the invention are contemplated which do not depart from the spirit and scope of the invention as defined by the foregoing teachings and appended claims. It is intended that the claims cover all such modifications that fall within their scope.

I claim as my invention:

1. A device for securing a ring to a person's finger, the device comprising:

an elongated loop connected at one end to a wristband adaptable to fit around the person's wrist, said loop and wristband formed from a single piece of material, said loop having a free end away from the wristband that can be threaded through the ring after which the wristband can be threaded though the loop between the free end and the ring and pulled until the loop is wrapped snugly around the ring, said wristband having spaced fastener openings and a plastic male member and plastic female receptacle fastener means, said fastener openings configured to receive the plastic male member, said plastic male member and plastic female receptacle fastener means configured to form a snap fit.

2. A method for securing a ring to a finger comprising the steps of:

providing a ring securing device comprising an elongated loop connected at one end to a wristband adaptable to fit around the person's wrist, said loop and wristband formed from a single piece of material, said loop having a free end away from the wristband, said wristband having spaced fastener openings and a plastic male member and a plastic female receptacle fastener means;

threading the free end of the loop through the ring;

threading the wristband though the loop between the free end and the ring;

pulling the wristband until the loop is wrapped snugly around the ring;

placing the ring on the finger; and securing the wristband to the wrist, by inserting the plastic male member through one of the spaced fastener openings and then into the plastic female receptacle to form a snap fit.

* * * * *